United States Patent [19]

Mobley

[11] Patent Number: 4,792,687

[45] Date of Patent: Dec. 20, 1988

[54] FREEMAN ION SOURCE

[76] Inventor: Richard M. Mobley, 40 Upper River Rd., Ipswich, Mass. 01938

[21] Appl. No.: 44,448

[22] Filed: Apr. 30, 1987

[51] Int. Cl.[4] ..... H01J 27/00

[52] U.S. Cl. ..... 250/423 R; 250/426

[58] Field of Search ..... 250/423 R, 426, 427; 313/309, 336, 351, 357, 362.1, 231.41

[56] References Cited

U.S. PATENT DOCUMENTS 4,467,240 8/1984 Futamoto et al. ..... 313/336

4,542,321 9/1985 Singh et al. ..... 250/423 R X

*Primary Examiner*—Eugene R. Laroche

*Assistant Examiner*—Steven J. Mottola

*Attorney, Agent, or Firm*—Henry C. Nields

[57] ABSTRACT

Specially shaped filaments improve the performance of Freeman ion sources. There are many different filament shapes covered by this invention. These shapes have two features in common—they have flat surfaces or facets, and two of these facets must join to form a knife edge. It is the purpose of these facets to direct negative ions away from the extraction slit. These negative ions are emitted from the filament normal to the surface. If the knife edge is directed toward the slit, very little of the negative ion flux can enter the extraction slit. In effect, the filament becomes invisible at the slit as far as negative ion flux is concerned. A converse application in which a large negative ion flux is desirable, requires shaping of the filament with a smooth concave surface in order to maximize the cathode surface normal to the extraction slit.

7 Claims, 8 Drawing Sheets

FREEMAN ION SOURCE

BACKGROUND OF THE INVENTION

1. Field of the Invention

The invention relates to so-called Freeman ion sources of the type shown, for example, in British Patent Specification No. 916,703 issued to James Harry Freeman and in Nuclear Instruments and Methods, Vol. 22 (1963) pages 306–316, North-Holland Publishing Co.

2. Description of the Prior Art

The major elements of a Freeman ion source are shown in FIG. 1. An electromagnet applies a magnetic field parallel to the filament. The usual gas feed line, vaporizer, filament conections and support structure are not shown in FIG. 1.

A typical Freeman ion source includes an arc chamber 1 which is typically a rectangular box with a removable lid, although chambers with a circular cross-section are also used.

Means 2 are provided to hold a straight tungsten filament 3 in position near an extraction slit or beam forming electrode 4. The filament shapes used in the prior art are straight rods of circular or rectangular cross-section. Penetrations through the arc chamber are provided to allow filament holders 2 and ceramic insulators 5 to support the filament and electrically isolate the filament from the arc chamber, while providing a snug seal against gas leakage, so that approximately 99% of the gas flow is out the extraction slit. A detail of a typical support (including the filament holder 2 and ceramic insulator 5) is shown in FIG. 2. As shown in FIG. 2, the filament holder 2 is moved from the outside of the arc chamber 1 into a suitable aperture 6 in the wall of the arc chamber 1, the ceramic insulator 5 is moved from the inside of the arc chamber 1 so as to surround the filament holder 2, and a suitable "circlip" fastener (not shown) is slipped into a notch 7 in the filament holder 2.

A magnetic field of modest strength, typically 50 to 200 gauss, is applied in a direction parallel to the filament. This can be provided by an electromagnet with suitable coil, iron yoke and pole tips, and variable power supply.

To cause an arc discharge in the source, so as to form an ion source plasma 25 (FIG. 3) with the usual cathode sheath 26, two d.c. power supplies are needed. A filament power supply (low voltage, high current) heats the filament so that it reaches incandescent temperatures and can emit electrons. Heavy connection clamps are provided at the filament ends to carry the filament current. An arc power supply of 50 to 200 volts and 1 to 50 amperes capability is applied between one filament connection and the arc chamber. The polarity is such that the filament is the cathode (negative) and the arc chamber is the anode (positive).

The arc discharge is controlled and stabilized by several means. The gas flow, external magnetic field, and the arc voltage must be adjustable and stable. Usually, a feedback means is provided to regulate the arc current by adjusting the filament current to emit more or less electron current.

It is the purpose of the ion source to provide ionized atoms or molecules. These ions are used to produce a beam of positive ions. Subsequent use of the beam is in the general field of ion accelerators. Most often, a positive beam 27 is extracted by means illustrated in FIG. 3. A high voltage d.c. power supply 31 provides an extraction voltage $V_e$ and an electric field which extracts positive ions which wander to the plasma meniscus. The ion temperature is typically less than 1 electron-volt, and the extraction voltage $V_e$ is typically tens of kilovolts. A lower voltage d.c. power supply 32 is applied across a second gap to provide a deceleration potential. This prevents electrons from streaming back to the source from the downstream plasma.

It is critically important that the plasma mensicus 33 be a stable, quiescent surface for good quality beam production. Much attention in the art is paid to the design of the beam forming electrode 34 as well, because it aids in confining the beam transverse to the extraction axis against the well-known space-charge forces of the positive beam, which tends to make the beam diverge. The shape and position of the plasma meniscus are variable because of a balance between the plasma density and the extraction field, as described by the well-known Child's law of space-charge limited extraction.

Poor meniscus formation and poor electrode design cause excess beam current to hit the extraction electrode, which in turn causes arc breakdown and can damage the electrodes and electronic instrumentation of the accelerator and associated equipment.

Thus, if the source and electrode design are poor in this regard, the usable output current of the machine is greatly reduced. The prior art is well explored in the areas of beam forming electrode design, choice of ion source type and electrode material, protection of electrical components and spark damage, and efforts to produce more beam current for commercially valuable beam species.

The problem with Boron

Boron is the only P-type dopant used in ion implanting in the silicon semiconductor industry. Boron has a very high melting point and no vaporizers have been developed to feed elemental boron into ion sources. The gaseous compound $BF_3$ (boron trifluoride) is universally used.

The Freeman-type ion source produces a good percentage of boron in the form of $B_{11}^+$, versus species $F^+$, $BF^+$, and $BF_2^+$, with boron percentage typically 30 to 40 percent. However, the beam formation is poor. The reason for this is disclosed herein for the first time, and the cure is the invention disclosed and claimed herein.

Gas efficiency in single aperture ion sources of the arc discharge type is typically 10–15%. This efficiency is the ratio of ion flux divided by the total flux of ions and neutral molecules. Ions are created by electron impact in the discharge. Thus, on the last pass of a neutral molecule or atom from the chamber wall or the plasma to the extraction slit, the molecule will be ionized with 10–15% probability. In the history of its passage through the source, an atom will be ionized several times and re-neutralized at the wall, until it reaches the extraction meniscus, usually as a neutral atom.

To produce boron ions from $BF_3$, one imagines repeated impacts. The probability of two impacts on last passage is thus about $0.10 \times 0.10 = 0.01$, or three impacts is 0.001. It is obvious that 30% boron fraction cannot be obtained by this means.

Instead, $BF_2^+$ and $BF^+$ are formed with high probability by the charge conserving collisions such as the following:

$$BF_3 + e^- = BF_2^+ + F^- + e^-$$

$$BF_3+e^- = BF_2^+ + F + 2\,e^-$$

$$BF_3+e^- = BF^+ + F_2^- + e^-$$

$$BF_3+e^- = BF^+ + F_2 + 2\,e^-$$

Subsequent boron production is largely by impact of $BF_2^+$ and $BF^+$ on cathode surfaces.

These cathode surfaces include the filament and filament holders in the case of the Freeman source as described above. The combined surface area of these surfaces is typically 5 to 10 times that of the extraction slit.

The positive molecular ions are accelerated across the cathode sheath with nearly the full arc potential, and hit the cathode surface with plenty of energy to completely fractionate the molecule. The term "cathode sheath" (FIG. 3) is used to describe the thin transition region from the cathode itself to the positive potential region of the arc. The potential distribution between the arc chamber wall and the cathode is drastically changed when an arc is struck, due to a small excess of positive ions in the plasma relative to the electron density. All this is to the advantage of producing the boron ion.

It is the discovery of this inventor that a copious flux of $F^-$ is also produced at the cathode surface, and accelerated to the arc chamber walls and the extraction slit with the aforesaid cathode sheath electric field. The flux of negative ions on the plasma meniscus is severely detrimental to good beam formation and makes the source performance with $BF_3$ gas poor from the aspects of both high current performance and high voltage breakdown.

SUMMARY OF THE INVENTION

The object of the invention is to avoid the detrimental effect of a high flux of energetic negative ions from a Freeman or any other type of ion source. This object is achieved by a novel design of shaped filaments for the ion source, making use of the inventor's discovery that the negative ion flux is directed normal to the cathode surfaces with very small angle deviations.

BRIEF DESCRIPTION OF THE DRAWINGS

One shape tested is shown in FIG. 4. This shape is that of an equilateral triangle with apex toward the extraction slit 34. Arrows indicate negative ion flux normal to cathode surfaces. The experiment demonstrating its effect is described below. The shapes shown in FIGS. 5 through 7 are variations which allow the same effect, but can be made with larger cathode surface area. FIG. 5 shows a tear drop shape; FIG. 6 shows a knife shape; and FIG. 7 shows a star shape.

It is obvious that wear of any of the filaments will round off the knife edge. However, one can run the filament to failure because some edge will remain, and as the filament gets smaller the amount of negative ion flux diminishes. In this case, the fractionating function is taken up by the cathode holders to a large degree. This phenomenon is commonly observed when source operation improves with an "old" filament of the round cross-section type.

Experimental Proof

Figure 1:
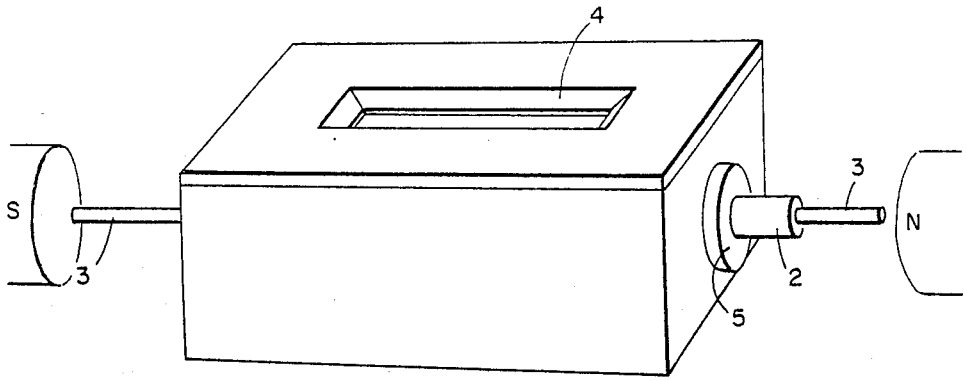
FIG. 1 is a somewhat diagrammatic view showing a Freeman ion source suitable for use with the invention.
Figure 2:
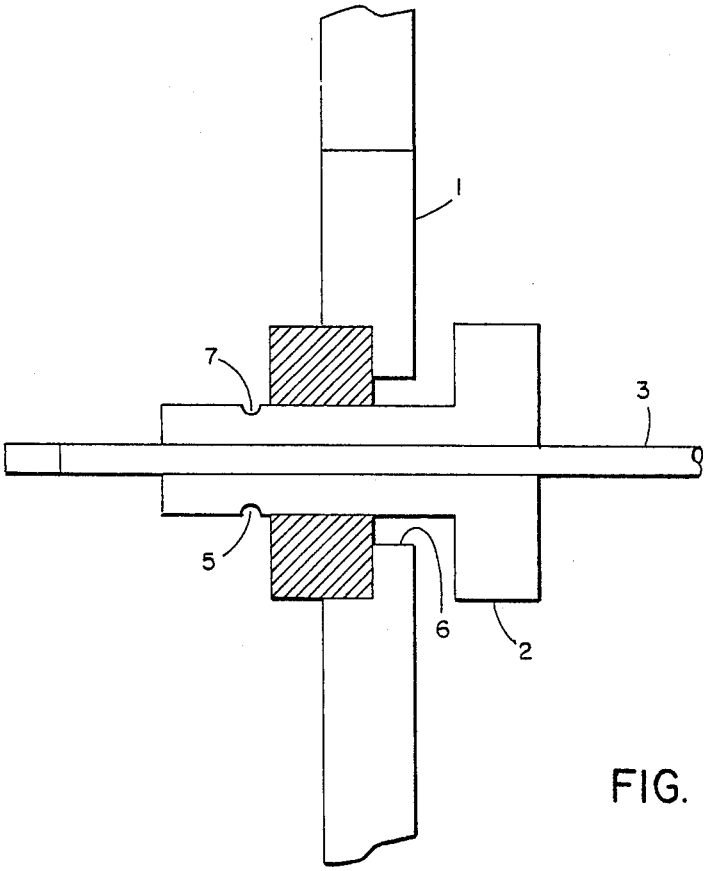
FIG. 2 is a detail showing the filament holder and insulator of the Freeman ion source of FIG. 1.
Figure 3:
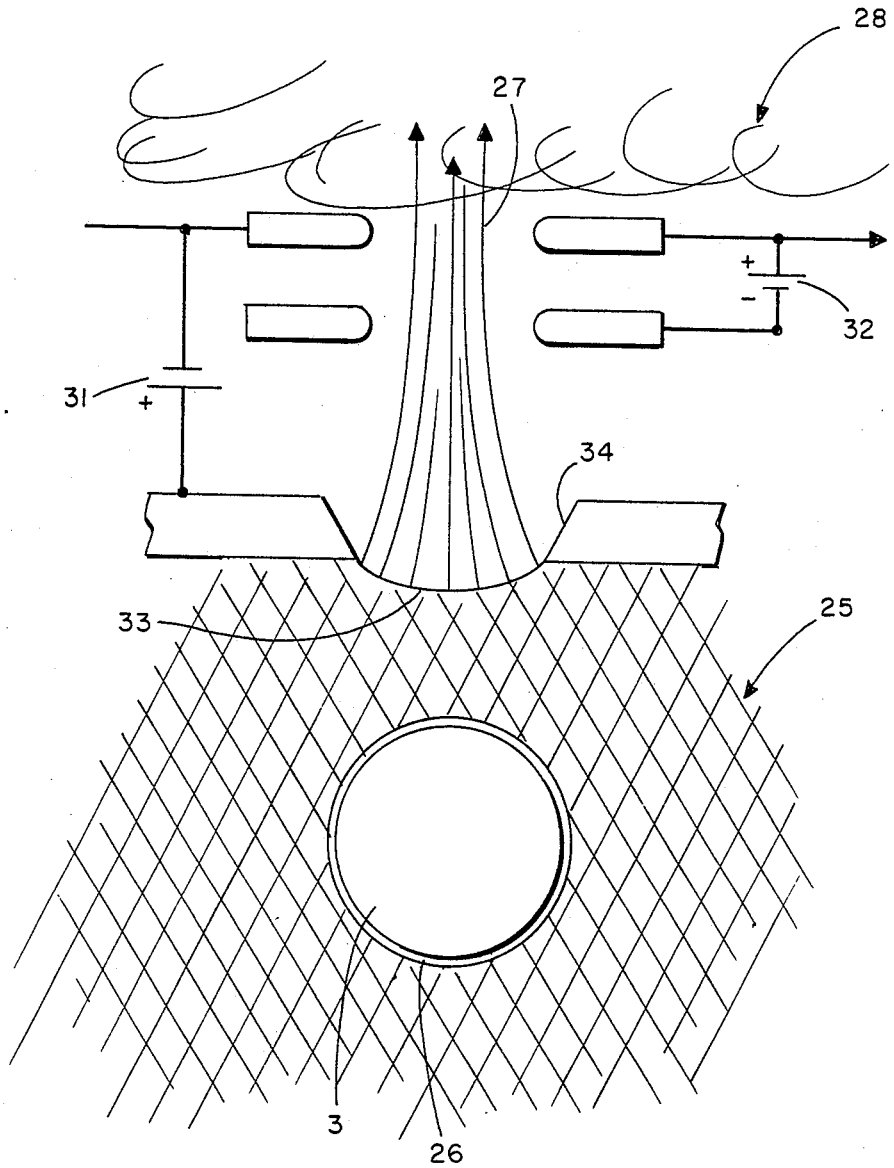
FIG. 3 is a schematic showing the beam formation and extraction system of the Freeman ion source of FIG. 1.
Figure 4:
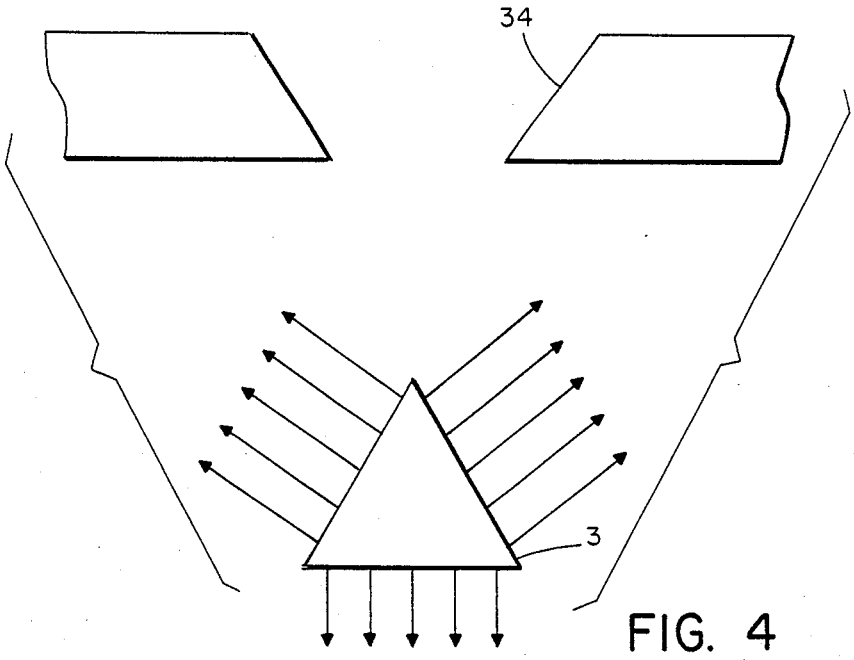
FIG. 4 is a detail showing one form of filament constructed in accordance with the invention for the Freeman ion source of FIG. 1.
Figure 5:
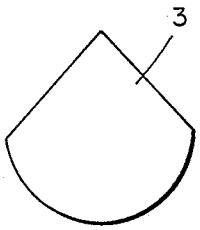
FIG. 5 is a detail showing another form of filament constructed in accordance with the invention.
Figure 6:
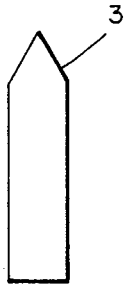
FIG. 6 is a detail showing still another form of filament constructed in accordance with the invention.
Figure 7:
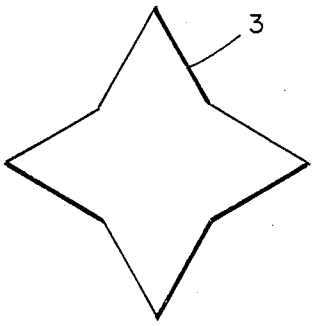
FIG. 7 is a detail showing yet another form of filament constructed in accordance with the invention.
Figure 8:
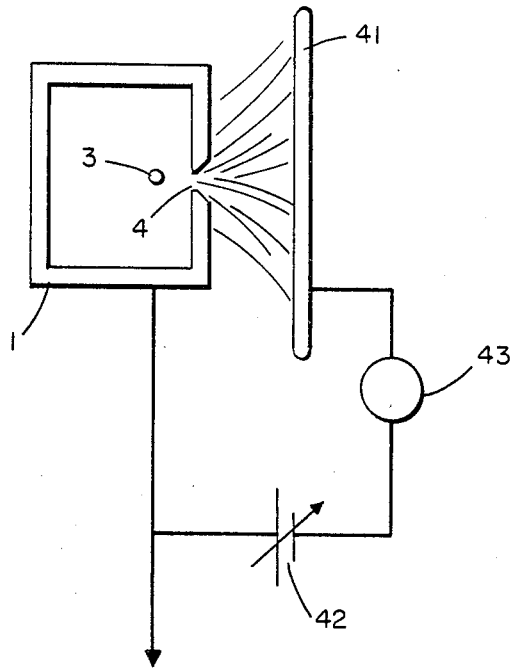
FIG. 8 is a schematic showing an experiment demonstrating measurements of negative ion current and energy made with a Freeman ion source.
Figure 13:
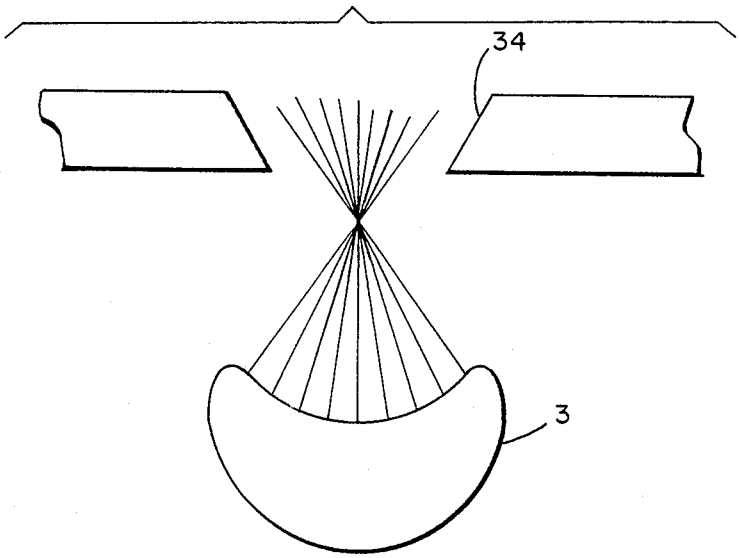
FIG. 13 is a view similar to FIG. 3 showing a modification of the filament of FIG. 3 suitable for producing a large negative ion flux.

With the simple circuit shown in FIG. 8 it is easy to measure the negative ion flux from the filament observed with $BF_3$. A large pickup plate 41 is biased with 0 to 200 volts negative voltage with respect to the arc chamber 1 by means of a power supply 42. This plate 41 will then attract all positive ions coming through the extraction slit 4, and repel electrons. Thus the current detected by the ammeter 43 represents a clockwise flow of (positive) current in the normal convention of current polarity. The arc chamber 1 is grounded, and the filament 3 is at the negative arc volts potential.

Figure 9:
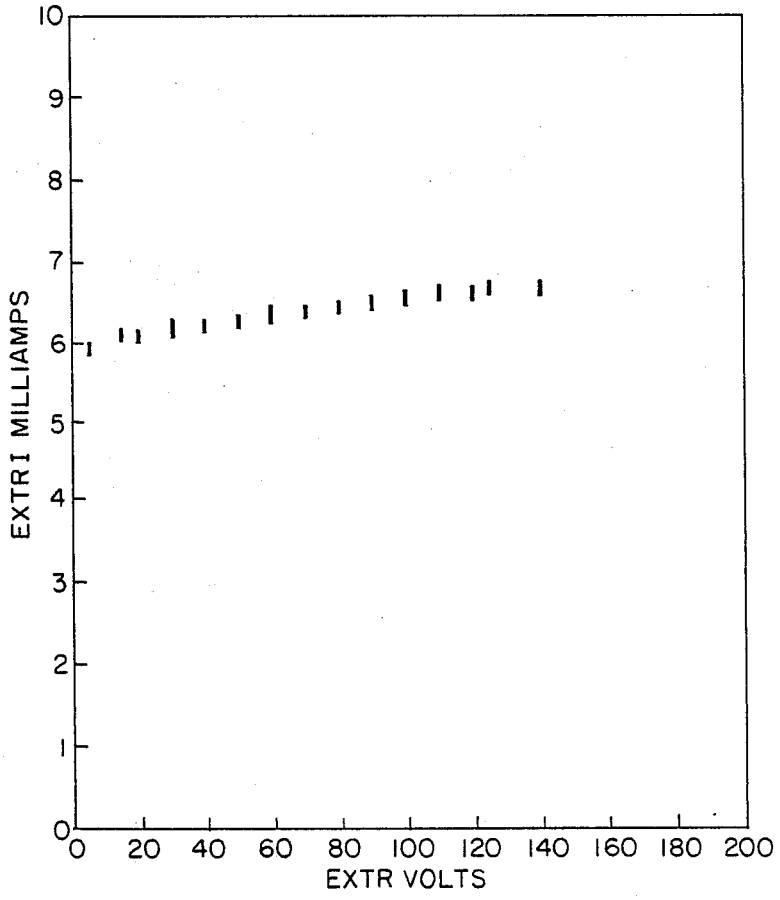
FIG. 9 is a graphical depiction of measurements made with the apparatus of FIG. 8 using a Freeman ion source with a prior-art round filament and argon.
Figure 10:
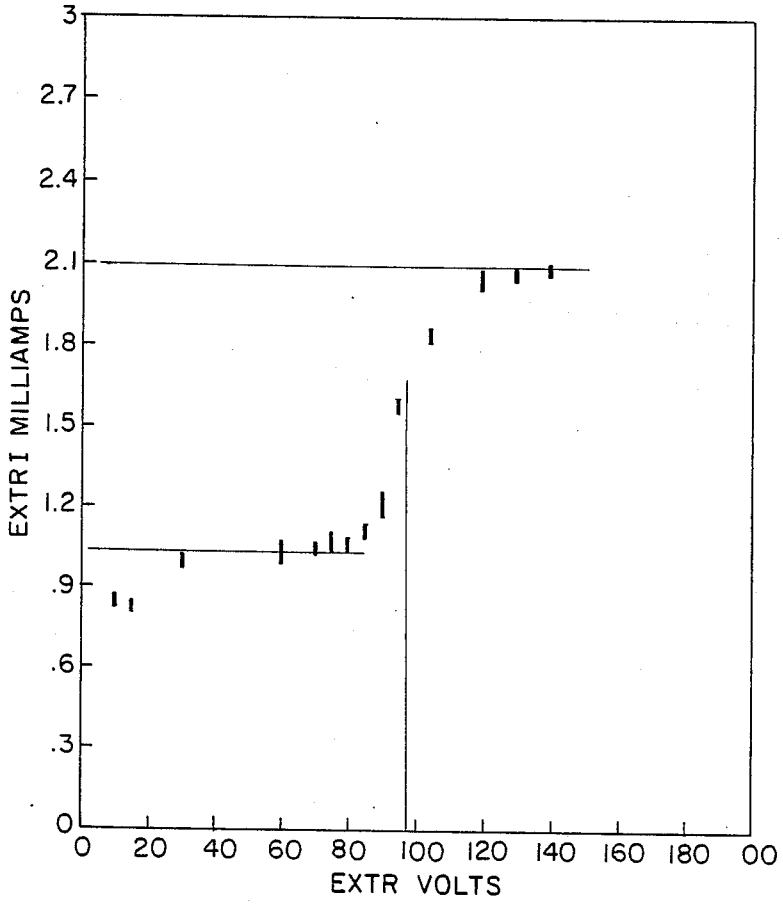
FIG. 10 is a graphical depiction of measurements made with the apparatus of FIG. 8 using a Freeman ion source with a prior-art round filament and boron trifluoride.

FIG. 9 shows the extracted current vs. extraction voltage curve when a Freeman source with round filament is run with argon gas. The curve shows no negative ion flux. (The arc voltage and current were 60 volts and 1.0 amperes, respectively.) A very small voltage of 10 volts is sufficient to reach a plateau in which essentially all of the positive ions are forced around the circuit and detected. FIG. 10 shows a much different characteristic curve for the round filament case when $BF_3$ gas is used. The interpretation of this curve is that below extraction voltage of 90 volts, energetic negative ions are also able to hit the pickup plate. In fact, negative ions of about 92 volts emanate from the source, and are only completely repelled when the extraction voltage is more than 100 volts. The plateaus indicate about 1.1 milliamperes of negative ions of 80 to 120 volts energy. (The arc voltage and current were 92 volts and 0.41 amperes, respectively.)

By measuring the two plateaus on the curve, it is seen that the negative flux is about 50% of the positive flux.

Figure 11:
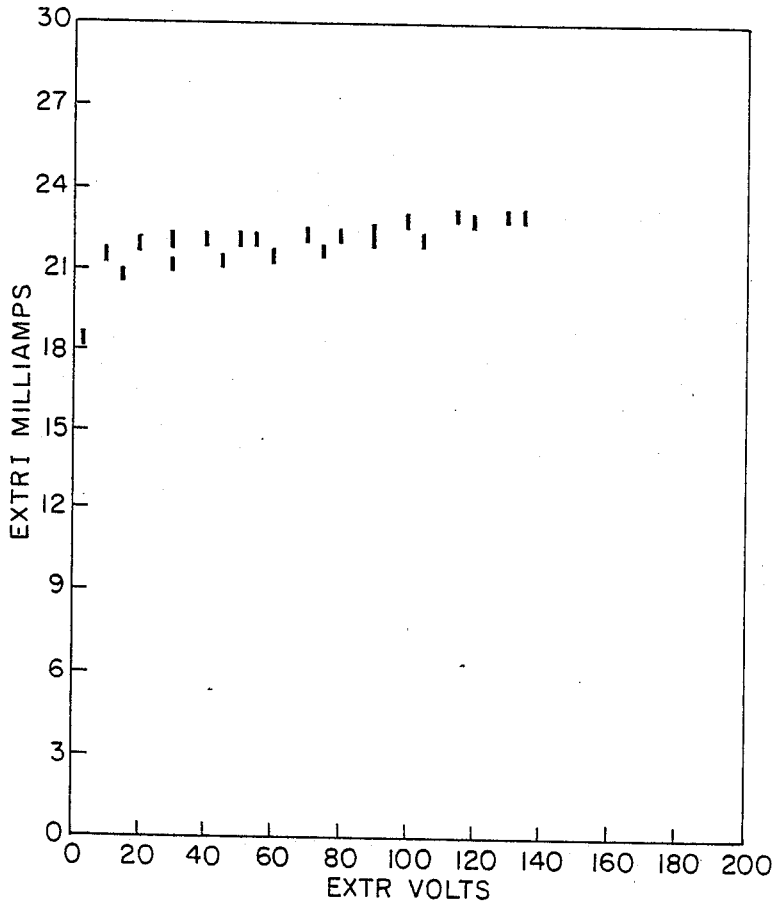
FIG. 11 is a graphical depiction of measurements made with the apparatus of FIG. 8 using a Freeman ion source with a triangular filament and boron trifluoride, the filament being oriented to deflect negative ions away from the extraction slit.
Figure 12:
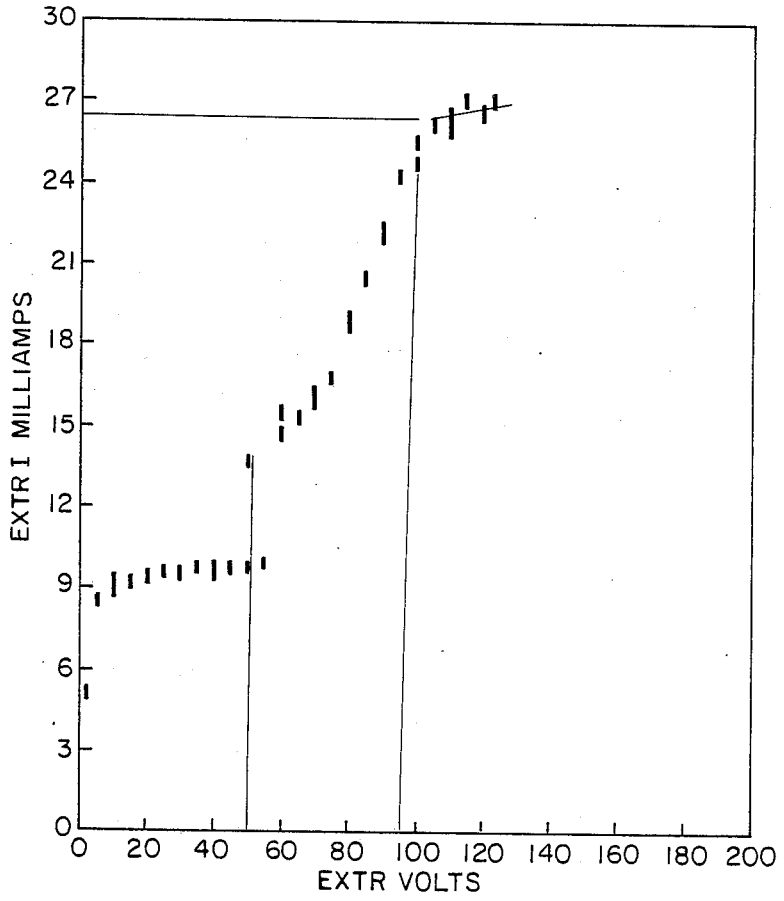
FIG. 12 is a graphical depiction of measurements made with a triangular filament and boron trifluoride, the filament being oriented to enhance negative ion flux.

FIG. 11 shows the same curves when the round filament is replaced by a triangular filament with a 60 degree apex facing the slit, using $BF_3$ gas. With the apex up, very little if any negative ion flux is observed. The orientation of the triangular filament is such as to deflect negative ions away from the slit. (The arc voltage and current were 87 volts and 4.02 amperes, respectively.) In FIG. 12, with the flat side of the filament facing up, one concludes that about 67% of the flux is due to negative ions. The current is much larger due to the higher arc current and the orientation of the flat surface. One notices now a flux of lower energy negative ions as well. The orientation of the triangle flat side is such as to enhance negative ion flux. 17 milliamperes of negative flux was observed with an energy range of 50 to 95 electron volts. (The arc voltage and current were 87 volts and 4.01 amperes, respectively.)

Identification of Negative Ion Species

It is shown that in the case of $BF_3$ source gas, the negative ion species was purely $F^-$. This was done by extracting a 5 kilovolt negative beam from a Freeman source (round filament) and detecting the beam after deflection by a mass spectrometer. The mass was about 19 atomic mass units, in agreement with the atomic mass of fluorine.

Conclusions

This disclosure thus reports the invention and discovery of the following:

(a) The discovery that energetic negative ions are the cause of poor beam formation in some ion sources, including the Freeman type.

(b) The invention of a class of filament shapes which avoid the defect caused by negative ion flux.

(c) The discovery of a means of producing a pure $F^-$ beam or other negative ion type. Negative ion flux can be greatly enhanced by shaping the filament to have a concave surface facing the extraction slit.

(d) The discovery that fractionation of molecular ion species in an ion source of the gaseous discharge type is enhanced by surfaces held at cathode potential.

(e) The discovery that ion sources, when operated with highly oxidizing or electronegative species such as $O_2$, F, Cl, Br, I are prone to produce energetic negative ions from cathode surfaces, and that the invention can be used to prevent deleterious effects of said negative ions when positive ions are extracted.

(f) Ion sources and extraction systems can now be designed for higher perveance (meaning higher current) performance with $BF_3$ gas.

I claim:

1. An ion source, comprising in combination an arc chamber having an extraction slit; a straight filament supported within said arc chamber near said extraction slit and aligned therewith; means for applying a magnetic field within said arc chamber parallel to said filament; a filament power supply adapted to heat said filament to electron-emitting temperatures; an arc power supply adapted to maintain an arc discharge within said arc chamber by applying a negative polarity to said filament with respect to said arc chamber; an extraction electrode outside said arc chamber and aligned with said extraction slit; a power supply adapted to apply a negative polarity to said extraction electrode with respect to said arc chamber, whereby positive ions in said arc discharge may be extracted through said extraction slit; said filament having surfaces so arranged that substantially no normal to any said surface passes through said extraction slit, whereby substantially no negative ions formed at said surfaces pass through said extraction slit.

2. An ion source according to claim 1, wherein said filament has an edge aligned with and pointing toward said extraction slit.

3. An ion source according to claim 2, wherein said edge is formed by the junction of two substantially planar surfaces at an apex ridge.

4. An ion source according to claim 1, wherein said filament is supported upon supports, wherein said electric field means maintains a positive potential on said arc chamber with respect to a cathode potential on said filament and supports so as to maintain said arc discharge, and wherein said filament and supports have surfaces so arranged that substantially no normal to any said surface at cathode potential passes through said extraction slit.

5. A method of producing boron ions with an ion source comprising in combination an arc chamber having an extraction slit; a straight filament supported within said arc chamber near said extraction slit and aligned therewith; means for applying a magnetic field within said arc chamber parallel to said filament; a filament power supply adapted to heat said filament to electron-emitting temperatues; an arc power supply adapted to maintain an arc discharge within said arc chamber by applying a negative polarity to said filament with respect to said arc chamber; an extraction electrode outside said arc chamber and aligned with said extraction slit; a power supply adapted to apply a negative polarity to said extraction electrode with respect to said arc chamber, whereby positive ions in said arc discharge may be extracted through said extraction slit; said filament having surfaces so arranged that substantially no normal to any said surface passes through said extraction slit, whereby substantially no negative ions formed at said surfaces pass through said extraction slit, said method comprising producing an arc discharge in boron trifluoride between said arc chamber having an extraction slit and said filament contained therein and, in so doing, maintaining said magnetic field parallel to said filament; producing boron ions by impact of $BF_2^+$ and $BF^+$ on cathode surfaces; said surfaces having normals thereto substantially none of which pass through said slit; and extracting boron ions through said slit.

6. A method of enhancing the production of elemental ion species relative to molecular ion species (when using materials such as $BF_3$, $SF_6$, $UF_6$, $SiF_4$ in an ion source comprising in combination an arc chamber having an extraction slit; a straight filament supported within said arc chamber near said extraction slit and aligned therewith; means for applying a magnetic field within said arc chamber parallel to said filament; a filament power supply adapted to heat said filament to electron-emitting temperatures; an arc power supply adapted to maintain an arc discharge within said arc chamber by applying a negative polarity to said filament with respect to said arc chamber; an extraction electrode outside said arc chamber and aligned with said extraction slit; a power supply adapted to apply a negative polarity to said extraction electrode with respect to said arc chamber, whereby positive ions in said arc discharge may be extracted through said extraction slit) comprising maximizing the area of the surface of said filament for a given cross-sectional area of said filament, maximizing the areas of the surfaces of other metal parts at the potential of said filament, and arranging the said surfaces so that substantially no normal to any said surface passes through said extraction slit.

7. An ion source for producing a large negative ion flux comprising in combination an arc chamber having an extraction slit; a straight filament supported within said arc chamber near said extraction slit and aligned therewith; means for applying a magnetic field within said arc chamber parallel to said filament; a filament power supply adapted to heat said filament to electron-emitting temperatures; an arc power supply adapted to maintain an arc discharge within said arc chamber by applying a negative polarity to said filament with respect to said arc chamber; an extraction electrode outside said arc chamber and aligned with said extraction slit; a power supply adapted to apply a positive polarity to said extraction electrode with respect to said arc chamber, whereby negative ions in said arc discharge may be extracted through said extraction slit; said filament having a smooth concave surface adapted to maximize the cathode surface having normals passing through the extraction slit.

* * * * *